United States Patent [19]

Iwaya

[11] 4,245,515

[45] Jan. 20, 1981

[54] DEVICE FOR SWITCHING POWER OF ACTIVE TOY

[76] Inventor: Hirokatsu Iwaya, No. 14-8, Shimane 1-chome, Adachi-ku, Tokyo, Japan

[21] Appl. No.: 2,241

[22] Filed: Jan. 9, 1979

[30] Foreign Application Priority Data

Jun. 15, 1978 [JP] Japan ..... 53-72384

[51] Int. Cl.[3] ..... F16H 21/16; A63H 11/14; F16H 3/08

[52] U.S. Cl. ..... 74/25; 74/63; 74/665 F; 74/665 S; 74/325; 46/150

[58] Field of Search ..... 74/63, 25, 665 F, 665 S, 74/325; 46/150, 266

[56] References Cited

U.S. PATENT DOCUMENTS

| | | | |
|---|---|---|---|
| 737,010 | 8/1903 | Oates et al. | 74/325 |
| 1,656,054 | 1/1928 | Gage | 74/25 |
| 3,178,853 | 4/1965 | Greenwood et al. | 46/150 X |
| 3,195,270 | 7/1965 | Glass et al. | 46/150 X |

FOREIGN PATENT DOCUMENTS

| | | | |
|---|---|---|---|
| 328864 | 11/1920 | Fed. Rep. of Germany | 46/150 |
| 456760 | 9/1913 | France | 46/150 |
| 1077936 | 11/1954 | France | 46/150 |

*Primary Examiner*—Leslie Braun

*Attorney, Agent, or Firm*—Friedman, Goodman & Teitelbaum

[57] ABSTRACT

A device for switching power of active toy comprising: a pair of drive gears having engaging lugs formed on their opposing inner surfaces for mutual engagement and crank portions for actuating predetermined acting portions; a switching mechanism; and a switching gear adapted to be brought by said switching mechanism into engagement with alternating one of said drive gears. When said switching gear engages one of said drive gears, the other drive gear is driven by the first-mentioned drive gear through their engaging lugs, at a certain time lag, so that said crank portions of said drive gears may be actuated with a phase differential.

3 Claims, 7 Drawing Figures

DEVICE FOR SWITCHING POWER OF ACTIVE TOY

Figure 1:
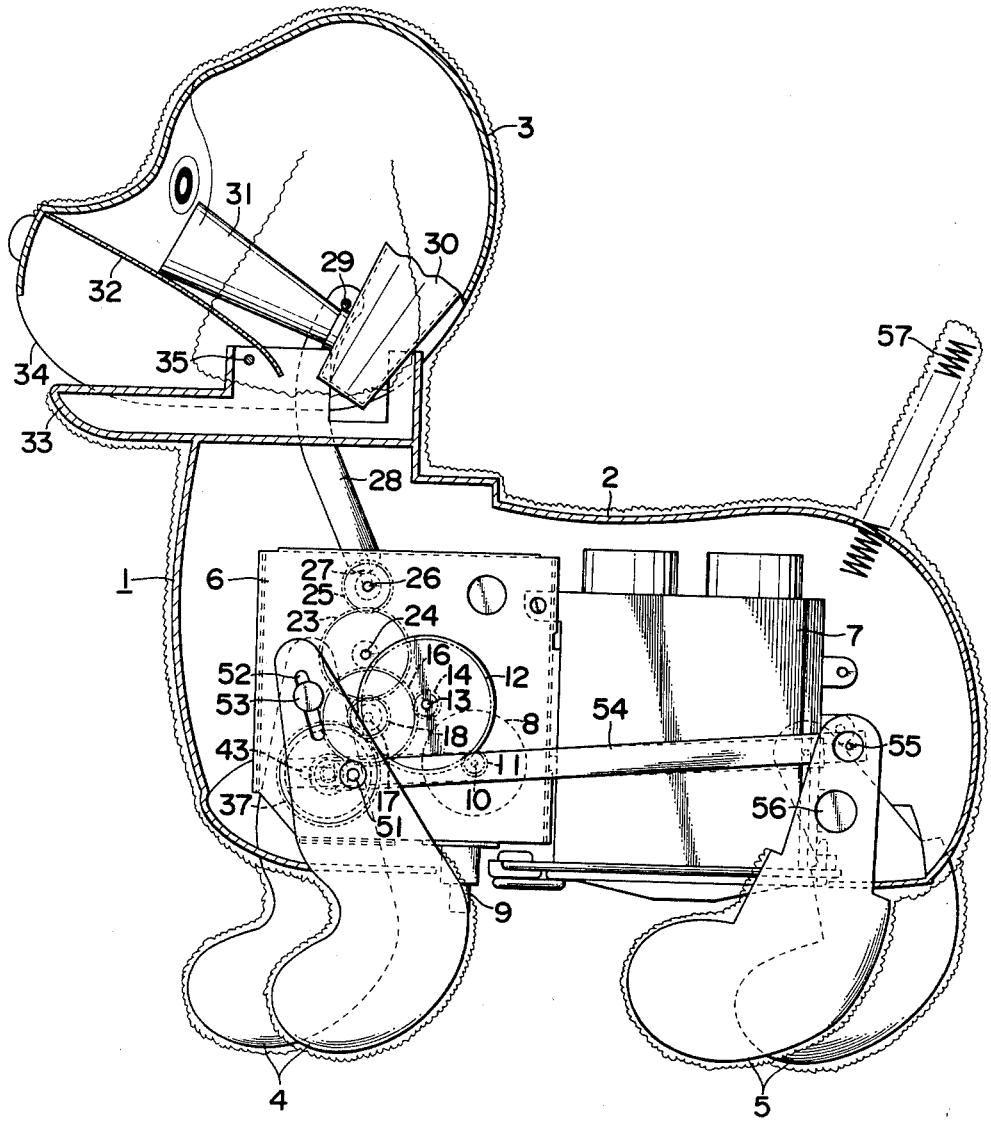

The present invention relates to a device for switching power for actuating active toy and, more particularly, to a device incorporated in an active toy having a figure of an animal such as dog and adapted to automatically switch the action of the toy.

Conventionally, the switching of actuating power of this kind of toy has been made by a reversible motor which can be driven in one and the other directions so as to switch the action.

This conventional measure, however, requires a complicated intermediate mechanism for the switching, resulting in a highly complicated construction and, accordingly, raised cost of manufacture.

The major object of the present invention is to obviate above-stated problem of the prior art.

Another object of the present invention is to provide a device for switching power of active toy characterized by comprising: a switching gear which is normally driven in one direction of rotation; a pair of independent drive gear adapted to be alternatingly engaged by the switching gear; engaging lugs provided on opposing inner surfaces of the drive gears and spaced by a predetermined distance from each other; and crank portions adapted to cause a predetermined action of the animal toy and formed opposite outer surfaces of the drive gears; whereby, when the switching gear engages one of the drive gears, the other drive gear is driven by the first-mentioned drive gear at a certain time lag through the engaging lugs, so that the crank portions may be driven at a certain phase differential, such that, for example, the action of the animal toy is switched from forward ambulation to walking round.

The invention provides a device for switching power of active animal toy comprising: a pair of drive gears which can be driven independently; engaging lugs provided on the opposing surfaces of the drive gears and spaced from each other by a predetermined distance; crank portions provided at the outer opposite surfaces of the drive gears; and a switching gear adapted to be moved by a switching mechanism into engagement with the drive gears alternatingly and adapted to be rotatively driven normally in one direction of rotation; whereby, when the switching gear engages and drives one of the drive gears, the other drive gear is driven by the first-mentioned drive gear at a certain time lag through the engaging lugs, so that the crank portions may be actuated at a certain phase differential.

According to this arrangement, it is possible to switch automatically two or more kinds of action of the toy and to enjoy these actions alternatingly through the differentiated action of the cranks, without using reversible motor.

Since the switching operation is made directly, without the aid of any intermediate mechanism, the construction of the toy as a whole is considerably simplified and the cost of manufacture is advantageously lowered.

Thus, the device of the invention is suitable for use in active toys having figures of animals, such as dog, which is adapted to automatically perform alternatingly forward ambulation and walking round.

The above and other objects, as well as advantageous features of the invention will become more clear from the following description of the preferred embodiment taken in conjunction with the accompanying drawings.

Figure 2:
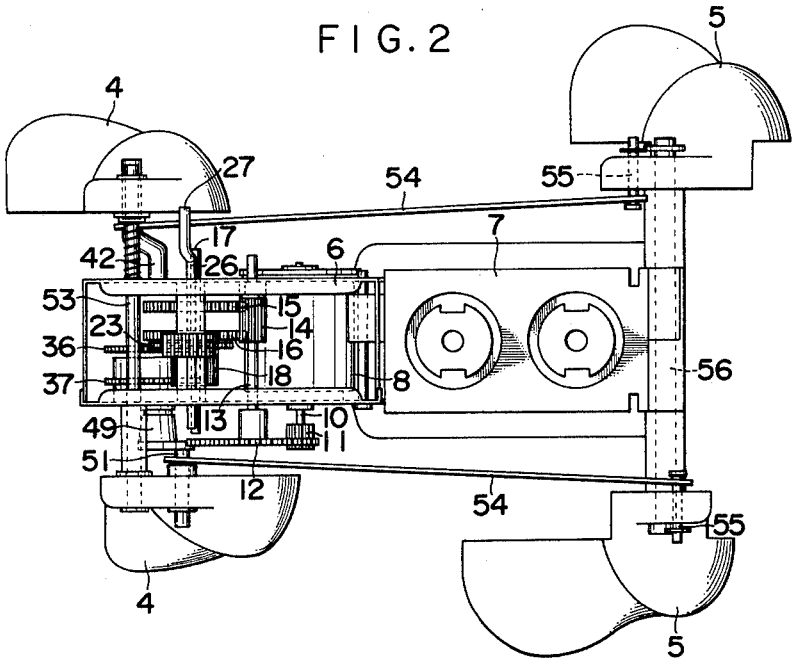
Figure 3:
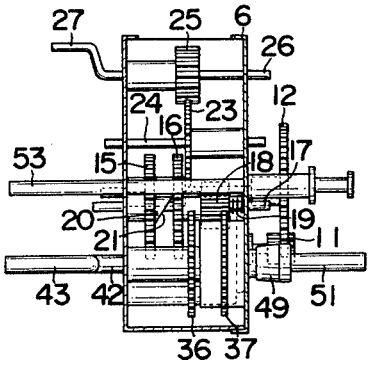
Figure 4:
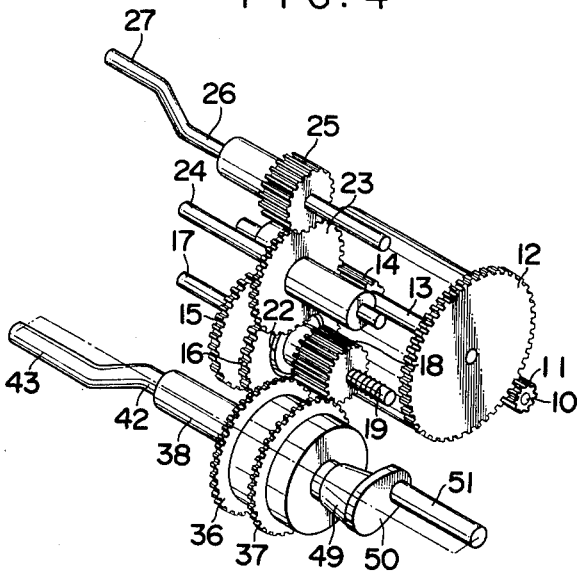
Figure 5:
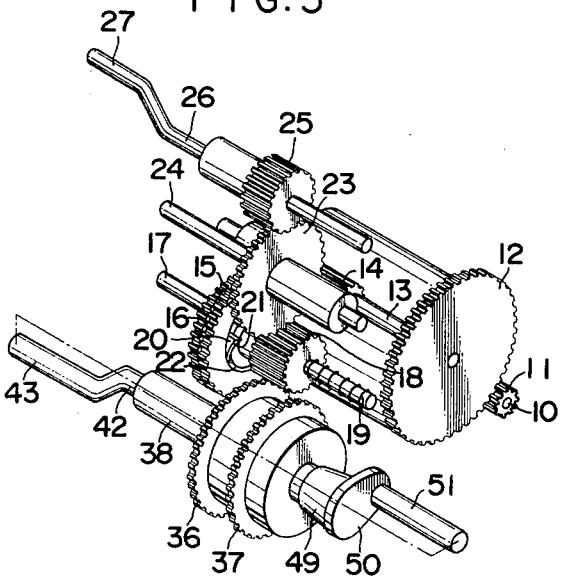
Figure 6:
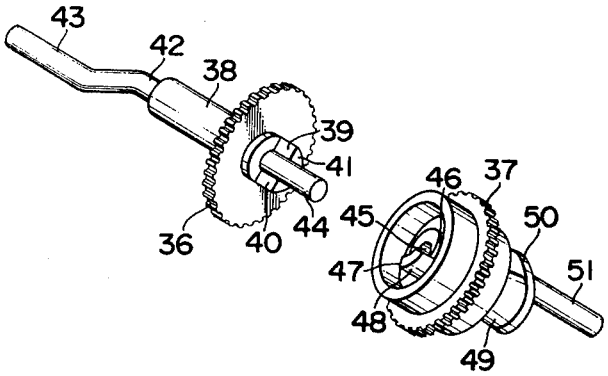
Figure 7:
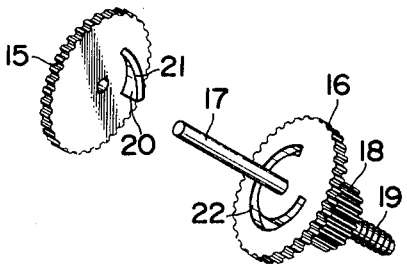

FIG. 1 is a front elevational view of an active toy having a power switching device, FIG. 2 is a cross-sectional plan view of the toy as shown in FIG. 1, FIG. 3 is a vertical sectional side elevational view of the toy as shown in FIG. 1, FIGS. 4 and 5 are perspective views of mechanism incorporated in the toy, FIG. 6 is a perspective view of a pair of drive gears of the mechanism as shown in FIGS. 4 and 5, and FIG. 7 is a perspective view of a switching mechanism.

Referring to the drawings, an active toy 1 having a figure of an animal such as dog is constituted by a body 2, head 3 and front and rear legs 4, 5.

A machine frame 6 is supported by the body 2 of the toy 1. The machine frame 6 has at its rear end portion a motor 8 which is electrically connected, through a switch 9, to a battery (not shown) in a battery case 7 which is mounted in the rear end portion of the body 2, so as to be energized and de-energized in accordance with the status of the switch 9.

A pinion 11 is fixed to the shaft 10 of the above-mentioned motor 8. A reduction gear 12 engaging the pinion 11 is fixed to one end of a connecting shaft 13 which in turn is supported by the machine fame 6. A free gear 15 and a driving gear 16, which constitute a rotation switching mechanism, engage an intermediate gear 14 which is fixed to the central portion of the connecting shaft 13.

The above-mentioned free gear 15 is attached to a slide shaft 17 carried by the machine frame 6, for sliding movement along the slide shaft 17, while the above-mentioned driving gear 16 is fixed to the slide shaft 17. Also, a switching gear 18 is fixed to the slide shaft 17 at opposite side of the driving gear 16 to the free gear 15. A coiled spring 19 is wound around the slide shaft 17, to act between the switching gear 18 and the machine frame 6.

The driving gear 16 is always biased to approach the free gear 15, through the switching gear 18, by the force of the coiled spring 19.

Referring now to FIG. 7, a substantially triangular engaging claw 20 is unitarily formed on the side of the free gear 15 confronting the driving gear 16, so as to extend in the direction of rotation. An arcuate edge 21 extending in the direction of rotation is formed on the claw 20. The engaging claw is adapted to be brought into and out of engagement with an engaging groove 22 formed in the driving gear 16, as the free gear 15 rotates. The number of gear teeth of the drive gear 16 is selected to be smaller than that of the free gear 15 by a suitable number.

An intermediate gear 23 is supported by a shaft 24 rotatably carried by the machine frame 6. The intermediate gear 23 is adapted to be engaged by the switching gear 18 in the state that the drive gear 16 engages the free gear 15 through the engaging claw 20. The intermediate gear 23 is engaged by an idle gear 25 which is fixed to a crank shaft 26 which in turn is rotatably supported by the machine frame 6. An oscillating rod 28 rotatably engages at its lower end the crank portion 27 of the crank shaft 26. The upper end of the oscillating rod 28 is engaged by a support shaft 29 which is supported at the back side of the head 3.

A whining body 30 is disposed between the support shaft 29 and the rear end of the head 3. The whining body has a loudener 31 retained in an upper jaw 32 which constitutes, in combination with a lower jaw 33, the mouth 34 of the animal.

The arrangement is such that, as the oscillating rod 28 moves up and down, the head 3 is swung back and forth around a support shaft 35, and the mouth 34 is opened and closed, so that the whining body is repeatedly pressed to whine.

A pair of drive gears 36, 37 are disposed so as to be alternatingly engaged by the switching gear 18. One 36 of these drive gears has a bearing sleeve 38 formed unitarily with its one side, while an engaging lug 41 having radial engaging surfaces 39, 40 is formed unitarily on the other side of the same drive gear 36. This drive gear 36 is fixed to a crank shaft 42 through the bearing sleeve 38. The crank shaft 42 is supported by the machine frame 6 and is connected at its one end to a crank portion 43.

The other drive gear 37 has a bearing bore 45 for receiving the other end 44 of the crank shaft 42. An engaging lug 48 having radial engaging surfaces 46, 47 is unitarily formed on the side of the drive gear 37 facing to the engaging lug 41. A bearing sleeve 49 is unitarily formed at the other side. Another crank portion 51 is connected to the outer end of the bearing sleeve 49, through a unitary connecting piece 50.

The engaging lugs 41, 48 are formed, respectively, to have widths smaller than a half of circle. There is a phase differential between these engaging lugs such that, when these lugs 41, 48 are made to contact with each other so as to engage their one engaging surfaces 39, 46, a rotational gap of about 90° is formed between the other engaging surfaces 40, 47.

The arrangement is such that the both crank portions 43, 51 are mounted on respective sides of the machine frame 6, with a phase differential of about 180° around the crank shaft 42, with the other end 44 of the crank shaft 42 of one drive gear 36 received by the bearing bore 45 of the bearing sleeve 49, so as to make the engaging lugs 41, 48 oppose each other.

Front legs 4 are rotatably engaged at their intermediate portions by the crank portions 43, 51. A support shaft 53 supported by the front upper portion of the machine frame 6 is received by elongated grooves 52 provided at the upper parts of the front legs 4.

Connecting rods 54 are rotatably engaged at their front ends by the crank portions 43, 51, while the rear ends thereof are rotatably engaged by the upper ends of the rear legs 5 through shafts 55. The rear legs 5 are rotatably carried at their intermediate portions by a support shaft 56 which in turn is supported by the rear end of the aforementioned battery case 7. A tail of the dog consisting of a coiled spring and having a configuration similar to that of a dog is denoted by a reference numeral 57.

In operation, as the switch 9 is closed, the motor 8 is energized to rotate the free gear 15 and the driving gear 16, through the pinion 11, reduction gear 12, and the connecting gear 14.

The free gear 15 and the driving gear 16 are rotated unitarily due to the mutual engagement performed by the engaging claw 20. As this unitary rotation is continued, the driving gear 16 is gradually deviated in the rotational direction from the free gear 15, through the guiding edge 21 of the engaging claw 20 formed on the free gear 15, due to the difference in the number of gear teeth of these gears 15, 16. As a predetermined number of rotation is reached, the engaging claw 20 comes to be disengaged completely from the engaging groove 22 of the drive gear 16, so that the driving gear 16 is disengaged from the free gear 15, as shown in FIG. 4. In this state, the driving gear 16 is driven by the connecting gear 14, while the end of the engaging claw 20 facing the surface other than the engaging groove 22.

At the same time, since the free gear 15 contacts at its one side of the machine frame 6, the switching gear 18 coaxial with the driving gear 16 is slid in the axial direction together with the slide shaft 17, overcoming the force of the coiled spring 19, and brought into engagement with the other drive gear 37. Then, as the other drive gear 37 is rotated, the engaging surface 47 of the engaging lug 48 provided on this drive gear 37 is brought into engagement with the engaging surface 40 of the engaging lug 41 formed on one drive gear 36, so that the drive gear 36 is driven by the other drive gear 37 with their engaging lugs 41, 48 engaging each other at their engaging surfaces 47, 40. In this state, there is a phase differential of about 90°, between the engaging surface 39 of one engaging lug 41 and the engaging surface 46 of the other engaging lug 48.

The crank portions 43, 51 connected to the drive gears 36, 37, respectively, are made to perform cranking action at about 180° interval, i.e. phase differential, so that the fore legs 4 are alternatingly swung back and forth and, at the same time, the rear legs 5 are also swung back and forth through the connecting rods 54. Consequently, the toy 1 makes a forward ambulation.

Then, as the engaging groove 22 of the driving gear 16 comes to be engaged again by the engaging claw 20 of the free gear 15, as a result of a predetermined number of rotation of the driving gear 16, the driving gear 16 is pressed against the free gear 15 by the biasing force of the coiled spring 19, so that the engaging claw 20 is again received by the engaging groove 22 of the driving gear 16, so that the gears 15, 16 commence the unitary rotation again, as shown in FIG. 5.

Simultaneously, the switching gear 18 is reset also, as is the case of the driving gear 16, by the biasing force of the coiled spring 19, and is moved out of engagement with the other drive gear 37 into engagement with the drive gear 36.

Then, as the drive gear 36 is rotated, the engaging surface 39 of the engaging lug 41 formed on the drive gear 36 comes to engage the engaging surface 46 of the engaging lug 48 of the other drive gear 37, so that the other drive gear 37 is rotatively and reciprocatingly driven by the drive gear 36 with their engaging lugs 41, 48 engaging each other at their engaging surfaces 39, 46.

Thus, when the switching gear 18 directly drives the other drive gear 37, the engaging surfaces 40, 47 of the engaging lugs 41, 48 engage each other, while the engaging surfaces 39, 46 are spaced by about 90° from each other. When the switching gear 18 comes to directly drive the drive gear 36, the other drive gear 37 is not rotated until the engaging surface 39 of the drive gear 36 comes into engagement with the engaging surface 46 of the other drive gear 37. Consequently, the front leg 4 at one side of the toy connected to the other drive gear 37 is not actuated and positioned at the rearwardly retracted position, while the crank portion 43 of the crank shaft 42 connected to the drive gear 36 is solely rotated by 90°, so that the front leg 4 at the other side of the toy connected to the crank portion 43 is solely moved backward, so as to move the toy 1. Then, the engaging surface 39 of the engaging lug 41 engages the engaging surface 46 of the engaging lug 48, so that both crank portions 43, 51 make the cranking actions such that one crank portion 43 is deviated from the other crank portion 51 by about 90°, in good contrast to the case of the ambulation in which the 180° phase differential is preserved between both crank portions.

Consequently, the toy makes such an action that the front side of the toy is slightly lifted around a pivot constituted by the rear legs 5, as if the dog jumps. Then, as the drive gear 36 comes to be driven by the switching gear 18, so as to drive the other drive gear 27, the front leg 4 associated with the other drive gear 37 is moved forwardly and lands, while the front leg 4 associated with the drive gear 36 functions as the pivot. In this case, the toy is declined to the side of the rear leg 5 associated with the other drive gear 37, so that only the front leg 4 associated with the drive gear 36 and the rear leg 5 associated with the other drive gear 37 are kept in contact with the ground surface, whereby the jumping action is changed to a walking round with the front leg 4 associated with the drive gear 36 positioned at the inner side of the circle along which the toy moves.

This operation is performed repeatedly, and the motion of the front legs 4 is transmitted to the left and right rear legs 5 through the connecting rods 54, so that the toy 1 walks round making jumps.

As the same time, i.e. simultaneously with the accomplishment of the engagement of the switching gear 18 with the drive gear 36, the switching gear 18 further engages the intermediate gear 23 so as to drive the idle gear 25 through the latter. Consequently, the crank shaft 26 fixed to the idle gear 25 makes a cranking action, so as to move the oscillating rod 28 up and down, and the head 3 is swung up and down around the support shaft 25. Simultaneously, the mouth 34 is opened and closed and the whining body whines. Thus, the toy 1 walks round, making whine and swinging its tail 57.

Then, as the drive gear 16 comes to be disengaged again from the free gear 15, due to the difference in the number of teeth of these gears, the switching gear 18 is released from the drive gear 36 and is brought into engagement with the other drive gear 37 as shown in FIG. 4. In this condition, the drive gear 36 is again driven by the other drive gear 37, so that the toy 1 is switched again to the ambulation, through the operation as described before.

From the foregoing description, it will be seen that, according to the invention, it is possible to automatically switch and change a plurality of kinds of action of the toy, without making use of a reversible motor, i.e. only through a drive in one direction of rotation.

What is claimed is:

1. A device for switching power of active toy comprising: a pair of drive gears adapted to be driven independently of each other, said drive gears having engaging lugs formed on their opposing inner surfaces for mutual engagement, and crank portions for actuating predetermined acting portions at their opposite outer surfaces; a switching mechanism; and a switching gear adapted to be brought by said switching mechanism into engagement with alternating one of said drive gears; wherein, when said switching gear engages one of said drive gears, the other drive gear is driven by the first-mentioned drive gear through their engaging lugs, at a certain time lag, so that said crank portions of said drive gears may be actuated with a phase differential.

2. A device as claimed in claim 1, wherein said switching mechanism includes a slide shaft, a free gear mounted on said slide shaft for free movement along the latter, a driving gear fixed to said slide shaft, a switching gear fixed to said slide shaft at opposite side of said driving gear to said free gear, means for biasing said driving gear and said switching gear toward said free gear, a substantially triangular engaging claw formed on one side of said free gear facing said driving gear and extending in the direction of rotation of said free gear, and an engaging groove formed in one side of said driving gear facing said free gear and extending in the direction of rotation of said driving gear, said engaging claw being adapted to be engaged by and disengaged from said engaging groove as a result of rotation of said free gear, said free gear and said drive gear having different number of gear teeth, said switching gear being adapted to be switched into engagement with one of said drive gears.

3. A device as claimed in claim 1, characterized by comprising engaging lugs formed on the opposing surfaces of said drive gears, each of said engaging lugs having a width smaller than that of a half circle and provided with a first and a second radially extending engaging surfaces, wherein when said engaging lugs engage each other at their first engaging surfaces, the second engaging surfaces of said engaging lugs are spaced by about 90° from each other.

* * * * *